United States Patent [19]

Hammar

[11] Patent Number: 4,575,037

[45] Date of Patent: Mar. 11, 1986

[54] STAND TO HOLD A BOOK OR THE LIKE IN AN OBLIQUE POSITION

[76] Inventor: Algot Hammar, 18, MUrtsbovägen, 790 21 BjursUs, Sweden

[21] Appl. No.: 618,953

[22] Filed: Jun. 8, 1984

[30] Foreign Application Priority Data

Jun. 8, 1983 [SE] Sweden ..... 8303251

[51] Int. Cl.[4] ..... A47B 19/00

[52] U.S. Cl. ..... 248/441.1; 248/174

[58] Field of Search ..... 248/441.1, 442, 447, 248/460, 469, 174, 152, 176; 211/73

[56] References Cited

U.S. PATENT DOCUMENTS

| | | | |
|---|---|---|---|
| 283,855 | 8/1883 | Blow | 248/442 |
| 1,169,869 | 2/1916 | Richards | 248/453 |
| 1,369,912 | 3/1921 | Brunhoff | 248/174 X |
| 3,178,141 | 4/1965 | Bloom | 248/113 |
| 4,073,460 | 2/1978 | Dale | 248/441.1 |

FOREIGN PATENT DOCUMENTS

| | | | |
|---|---|---|---|
| 866755 | 2/1953 | Fed. Rep. of Germany | 248/174 |
| 2551466 | 5/1977 | Fed. Rep. of Germany | 248/441.1 |
| 778162 | 3/1935 | France | 248/442 |
| 644844 | 10/1950 | United Kingdom | 248/460 |

*Primary Examiner*—J. Franklin Foss

*Attorney, Agent, or Firm*—Finnegan, Henderson, Farabow, Garrett & Dunner

[57] ABSTRACT

A stand intended to hold books, covers and similar objects in an oblique position comprises a support which in end view is substantially Z-shaped where the Z at the under side of the bottom portion thereof and at the over side of the upper supporting portion thereof has skid resistant elements. The bottom portion may have the free end thereof bent to form a compartment to house pens and similar objects. The skid resistant elements are in the shape of strips from rubber or similar material and the elements may be profiled so as to hold calendar cards and the like.

4 Claims, 2 Drawing Figures

STAND TO HOLD A BOOK OR THE LIKE IN AN OBLIQUE POSITION

BACKGROUND OF THE INVENTION

The present invention relates to a novel construction for a stand, intended to hold a book, a cover or similar object in an oblique position, convenient for reading or writing.

A book stand comprising an inclined surface to support the rear side of a book and a lower surface to support the lower part of the book is described in U.S. Pat. No. 1,169,869 S. H. Richards. This book stand requires a considerable amount of material to prevent it from tilting and is further limited to books having a height within some relatively narrow limits.

SUMMARY OF THE INVENTION

In accordance with the invention a stand for a book, a cover or similar object is provided which can be placed upon a desk or the like in a skid resistant manner. The stand includes a stand structure which in section and in the use position thereof is substantially Z-shaped and which on the bottom portion of its lower surface as well as on the top portion of an upper surface, which is intended to support the object has skid resistant means.

Accordingly, it is an object of the invention to provide a stand having a novel construction with a compact shape.

Another object of the invention is to provide a light weight movable stand which has friction increasing surfaces.

A further object is to provide a stand which is combined with a compartment for pens and similar objects and also with a holder for calendar cards and the like.

Still further objects will appear from the appended description of the invention taken in combination with the drawing.

DESCRIPTION OF THE PREFERRED EMBODIMENT

Figure 1:
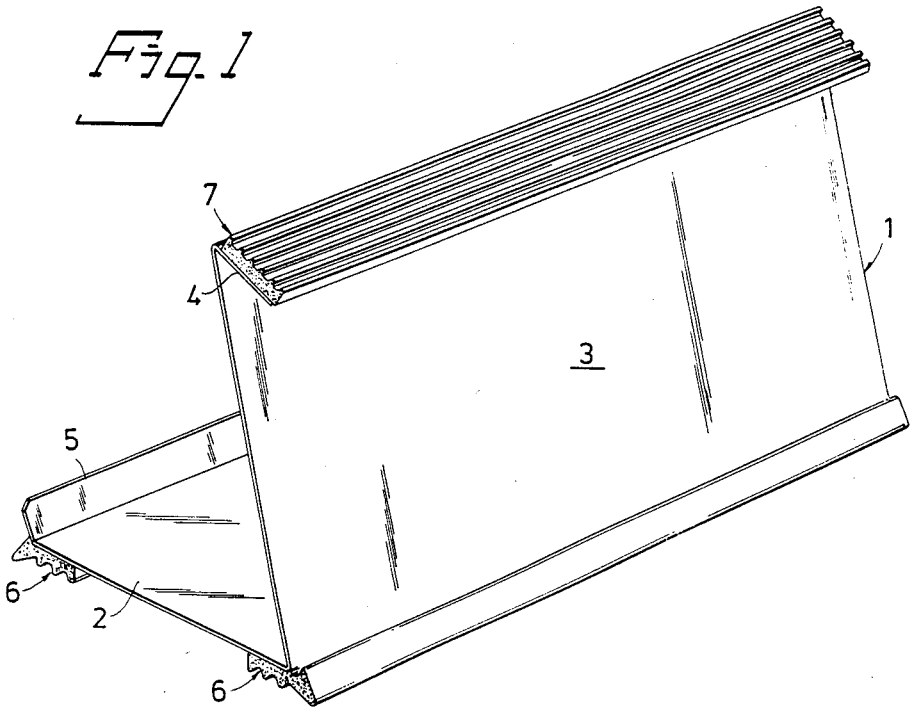
FIG. 1 is a perspective view of the new stand for books and covers.
Figure 2:
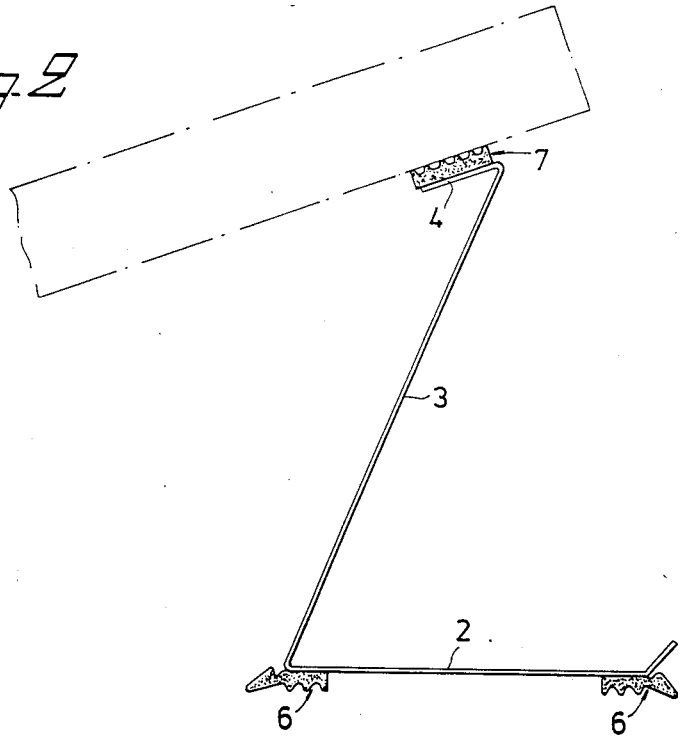
FIG. 2 is an end view of the stand according to FIG. 1 with a book in phantom lines.

Referring to the drawing the new stand for books, covers and similar objects, includes a member 1 preferably made from aluminium and having the general shape of a Z with a substantially horizontal bottom portion 2, which continues in an obliquely arranged front portion 3 which in the upper part thereof continues in a support portion 4 which forms an angle with the horisontal plane which is considerably less than the angle of the portion 3. The bottom portion 2 preferably ends in a relatively narrow end portion 5, which for a purpose to be explained is bent obliquely upwards.

The bottom portion 2 has at the under side thereof a friction increasing element such as a profiled strip 6 of soft rubber material, plastic or other material with similar properties and the support portion 4 has at the over surface thereof similar elements. In the illustrated example this element is a profiled strip 7.

Owing to the fact that the support surface 4 will be located substantially over the middle of the bottom portion 2 and owing to the fact that the friction increasing elements prevent an undesired relative displacement between on one hand the book and the support portion 4 and on the other hand between the stand and the support upon which it rests the weight of the book itself will contribute to ensure that the book in spite of the oblique position thereof will be held stationary. Such an oblique position further prevents the book from being unintentionally closed. The bent portion 5 will form with the rest of the stand a pen stand or the like.

As appears from the drawing the strip 6 secured to the bottom surface may have an end formed as a flap. Since the strip is resilient and has a portion which extends over the front portion of the stand it is possible to insert a calendar card or similar flat object such that the object is held in place by the flap and supported by surface 3. If the object has such a height that the upper edge thereof contacts the transition to the portion the object will be securedly held in place.

What I claim is:

1. A portable support stand mounted on a substantially planar surface for supporting objects, which comprises:

an individual support frame having a series of integrally connected sections including:

a base member having a substantially planar configuration and a pair of substantially parallel end sections, said base member also having a lower surface proximate the substantially planar surface, a vertical extension extending upward from one of said end sections at a predetermined angle less than 90° relative to said base member, said vertical extension having an upper edge opposite the portion of said vertical extension connected to said base member, and a sloped member depending from said upper edge at an angle less than 90° relative to said base member, the angular orientation of said base member, said vertical extension and said sloped member providing a substantially Z-shaped side sectional configuration, the length of said sloped member measured from said upper edge being substantially less than the length of said base member measured between said end sections;

means affixed to said lower surface to increase friction of said base member for restricting movement thereof; and means affixed to said sloped member to increase friction for preventing the objects supported by said sloped member and said substantially planar surface from movement relative thereto.

2. The support stand as defined in claim 1, wherein said base member includes an upper surface opposite said lower surface and wherein said series of integrally connected sections include retention means extending upward from said remaining end section for retaining objects positioned on said upper surface of said base member.

3. The support stand as defined in claim 1, wherein said restricting means and said preventing means are of corrugated elastomeric material.

4. The support as defined in claim 3, wherein said restricting means includes a strip of said elastomeric material affixed to said lower surface of said base member adjacent said vertical extension, said at least one strip having an appendage for receiving objects supported on said vertical extension.

* * * * *